US008695553B2

(12) United States Patent
Moriya et al.

(10) Patent No.: US 8,695,553 B2
(45) Date of Patent: Apr. 15, 2014

(54) CONTROL DEVICE AND CONTROL METHOD FOR STARTER, AND VEHICLE

(75) Inventors: Kouki Moriya, Aichi-ken (JP); Jumpei Kakehi, Toyota (JP); Hasrul Sany Bin Hashim, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days.

(21) Appl. No.: 13/818,892

(22) PCT Filed: Mar. 25, 2011

(86) PCT No.: PCT/JP2011/057370

§ 371 (c)(1), (2), (4) Date: Apr. 22, 2013

(87) PCT Pub. No.: WO2012/131845

PCT Pub. Date: Oct. 4, 2012

(65) Prior Publication Data

US 2014/0000541 A1 Jan. 2, 2014

(51) Int. Cl.
*F02N 11/08* (2006.01)

(52) U.S. Cl.
USPC ..... 123/179.3; 123/179.4; 123/90.15; 701/113

(58) Field of Classification Search
USPC ..... 123/179.3, 179.4, 179.16, 179.18, 123/90.15; 701/113
See application file for complete search history.

(56) References Cited

U.S. PATENT DOCUMENTS

| | | | | |
|---|---|---|---|---|
| 7,263,432 | B2 * | 8/2007 | Guillarme et al. | 701/113 |
| 7,270,094 | B2 * | 9/2007 | Mashiki et al. | 123/90.11 |
| 7,305,957 | B2 * | 12/2007 | Mashiki | 123/179.4 |
| 7,438,042 | B1 * | 10/2008 | Kawada | 123/198 B |
| 8,239,121 | B2 * | 8/2012 | Hattori et al. | 701/105 |
| 8,251,035 | B2 * | 8/2012 | Hirano et al. | 123/179.4 |
| 8,267,061 | B2 * | 9/2012 | Moriya et al. | 123/179.3 |
| 8,554,453 | B2 * | 10/2013 | Moriya et al. | 701/113 |
| 8,573,174 | B2 * | 11/2013 | Moriya et al. | 123/179.3 |
| 2010/0242905 | A1 * | 9/2010 | Machida et al. | 123/339.14 |
| 2013/0104828 | A1 * | 5/2013 | Moriya et al. | 123/179.3 |
| 2013/0104830 | A1 * | 5/2013 | Moriya et al. | 123/179.4 |
| 2013/0118431 | A1 * | 5/2013 | Moriya et al. | 123/179.3 |
| 2013/0289855 | A1 * | 10/2013 | Kitano et al. | 701/113 |

FOREIGN PATENT DOCUMENTS

| | | |
|---|---|---|
| EP | 2 159 410 | 3/2010 |
| JP | 2002 70699 | 3/2002 |
| JP | 2005 330813 | 12/2005 |
| JP | 2010 242697 | 10/2010 |
| JP | 2011-190799 A | 9/2011 |

OTHER PUBLICATIONS

International Search Report Issued May 17, 2011 in PCT/JP11/57370 Filed Mar. 25, 2011.

Office Action issued Apr. 16, 2013, in Japanese Patent Application No. 2013-501058 (with English language translation).

* cited by examiner

*Primary Examiner* — Thomas Moulis

(74) *Attorney, Agent, or Firm* — Oblon, Spivak, McClelland, Maier & Neustadt, L.L.P.

(57) ABSTRACT

A starter can independently drive an actuator for moving a pinion gear to a position where the pinion gear is engaged with a ring gear and a motor for rotating the pinion gear. When synchronization between the ring gear and the pinion gear is restricted, a rotation mode in which the pinion gear is rotated before the actuator is driven is restricted.

6 Claims, 7 Drawing Sheets

CONTROL DEVICE AND CONTROL METHOD FOR STARTER, AND VEHICLE

TECHNICAL FIELD

The present invention relates to a control device and a control method for a starter, and a vehicle, and particularly to a technique for restricting rotation of a pinion gear before engagement between the pinion gear and a ring gear provided around an outer circumference of a flywheel or a drive plate of an engine.

BACKGROUND ART

In order to improve fuel efficiency or reduce exhaust emission, some cars having an internal combustion engine such as an engine include what is called an idling-stop (or economy-running) function, in which an engine is automatically stopped while a vehicle stops and a driver operates a brake pedal, and the vehicle is automatically re-started, for example, by a driver's operation for re-start such as decrease in an amount of operation of a brake pedal to zero.

In this idling-stop, the engine may be re-started while an engine rotation speed is relatively high. In such a case, with a conventional starter in which pushing-out of a pinion gear for rotating the engine and rotation of the pinion gear are caused by one drive command, the starter is driven after waiting until the engine rotation speed sufficiently lowers, in order to facilitate engagement between the pinion gear and a ring gear of the engine. Then, a time lag is caused between issuance of a request to re-start an engine and actual engine cranking, and the driver may feel uncomfortable.

In order to solve such a problem, European Patent Publication No. 2159410 (PTL 1) discloses a technique, with the use of a starter configured such that a pinion gear engagement operation and a pinion gear rotational operation can individually be performed, for causing a pinion gear to perform a rotational operation prior to the pinion gear engagement operation when a re-start request is issued while a rotation speed of an engine is being lowered.

CITATION LIST

Patent Literature

PTL 1: European Patent Publication No. 2159410

SUMMARY OF INVENTION

Technical Problem

For example, however, in a case where a rotation speed of an engine or a pinion gear cannot be detected, a case where a time from start of a pinion gear engagement operation until completion thereof varies, and the like, synchronization between a rotation speed of a ring gear and a rotation speed of the pinion gear is difficult to achieve. When the pinion gear is rotated in such a case, difference between the rotation speed of the pinion gear and the rotation speed of the ring gear may become great, contrary to the intention. Therefore, great sound is likely to be generated when the pinion gear and the ring gear are engaged with each other. In addition, the pinion gear may wear in an early stage.

An object of the present invention is to lower sound which may be generated at the time when an engine is cranked and to reduce an amount of wear of a gear.

Solution to Problem

In one embodiment, a starter includes a second gear that can be engaged with a first gear coupled to a crankshaft of an engine, an actuator that moves, in a driven state, the second gear to a position where the second gear is engaged with the first gear, and a motor that rotates the second gear. A control device for a starter includes a control unit that drives the actuator and the motor in a rotation mode in which the motor is driven before the actuator is driven. The rotation mode is restricted when synchronization between a rotation speed of the first gear and a rotation speed of the second gear is restricted.

According to this embodiment, when synchronization between the rotation speed of the first gear and the rotation speed of the second gear is restricted and consequently synchronization is difficult to achieve, the rotation mode in which the second gear is rotated before drive of the actuator for moving the second gear to the position where the second gear is engaged with the first gear is restricted. Therefore, unintended increase in difference between a rotation speed of a pinion gear and a rotation speed of a ring gear is suppressed. Consequently, sound which may be generated at the time of collision between the pinion gear and the ring gear can be lowered and an amount of wear of a gear can be decreased.

In another embodiment, when the synchronization is restricted, the actuator and the motor are driven in an engagement mode in which the second gear is engaged with the first gear.

According to this embodiment, the second gear is engaged with the first gear without rotating the second gear. Therefore, the engine can be cranked in order to satisfy a start request.

In another embodiment, when a rotation speed of the engine is higher than an upper limit value, the actuator and the motor are driven in the rotation mode. When a rotation speed of the engine is equal to or lower than the upper limit value, the actuator and the motor are driven in the engagement mode. When the synchronization is restricted, the upper limit value is increased in the second state.

According to this embodiment, the upper limit value for the engine rotation speed at which the engagement mode is carried out when synchronization is restricted is higher than the upper limit value for the engine rotation speed at which the engagement mode is carried out when synchronization is not restricted. Therefore, even though the rotation mode is restricted, the engine is quickly cranked.

In another embodiment, when a rotation speed of the engine is higher than an upper limit value, the actuator and the motor are driven in the rotation mode. When a rotation speed of the engine is equal to or lower than the upper limit value, the actuator and the motor are driven in the engagement mode. When the synchronization is restricted, a rate of lowering in rotation speed of the engine is increased in the second state.

According to this embodiment, a rate of lowering in rotation speed of the engine when synchronization is restricted is higher than a rate of lowering in rotation speed of the engine when synchronization is not restricted. Therefore, the rotation speed of the engine quickly lowers to the upper limit value for the engine rotation speed at which the engagement mode is carried out. Therefore, even though the rotation mode is restricted, the engine is quickly cranked.

Advantageous Effects of Invention

When synchronization between a rotation speed of the first gear and a rotation speed of the second gear is restricted, the rotation mode in which the second gear is rotated before drive of the actuator for moving the second gear to the position where the second gear is engaged with the first gear is restricted. Therefore, unintended increase in difference between a rotation speed of a pinion gear and a rotation speed of a ring gear is suppressed. Consequently, sound which may be generated at the time of collision between the pinion gear and the ring gear can be lowered and an amount of wear of a gear can be decreased.

DESCRIPTION OF EMBODIMENTS

Figure 1:
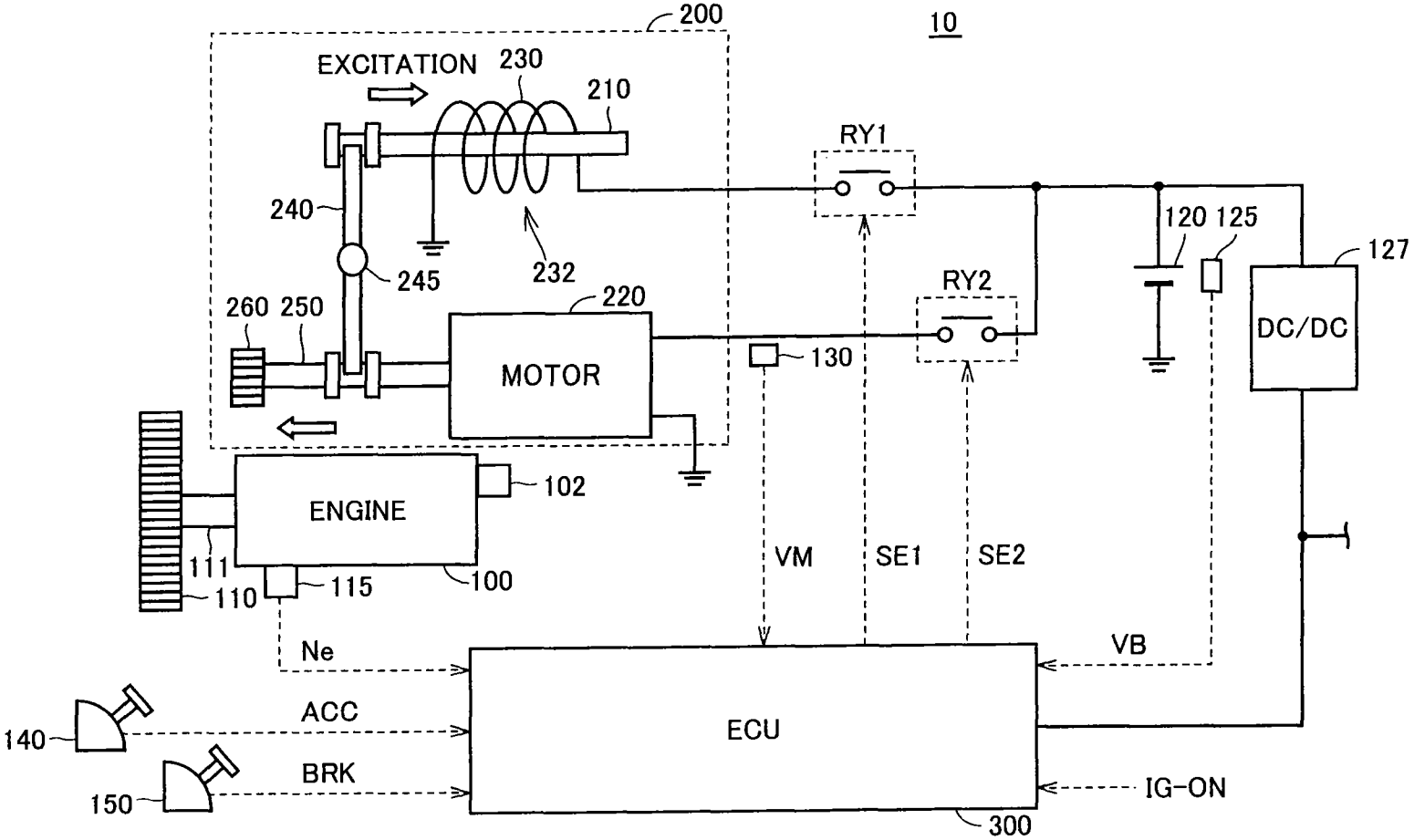
FIG. 1 is an overall block diagram of a vehicle.

An embodiment of the present invention will be described hereinafter with reference to the drawings. In the description below, the same elements have the same reference characters allotted. Their label and function are also identical. Therefore, detailed description thereof will not be repeated.

FIG. 1 is an overall block diagram of a vehicle 10. Referring to FIG. 1, vehicle 10 includes an engine 100, a battery 120, a starter 200, an ECU 300, and relays RY1, RY2. Starter 200 includes a plunger 210, a motor 220, a solenoid 230, a coupling portion 240, an output member 250, and a pinion gear 260.

Engine 100 generates driving force for running vehicle 10. A crankshaft 111 of engine 100 is connected to a drive wheel, with a powertrain structured to include a clutch, a reduction gear, or the like being interposed.

Engine 100 has a VVT (Variable Valve Timing) mechanism 102. VVT mechanism 102 changes a phase of an intake valve or an exhaust valve. Engine 100 is provided with a rotation speed sensor 115. Rotation speed sensor 115 detects a rotation speed Ne of engine 100 and outputs a detection result to ECU 300.

Battery 120 is an electric power storage element configured such that it can be charged and can discharge. Battery 120 is configured to include a secondary battery such as a lithium ion battery, a nickel metal hydride battery, a lead-acid battery, or the like. Alternatively, battery 120 may be implemented by a power storage element such as an electric double layer capacitor.

Battery 120 is connected to starter 200 with relays RY1, RY2 controlled by ECU 300 being interposed. Battery 120 supplies a supply voltage for driving to starter 200 as relays RY1, RY2 are closed. It is noted that a negative electrode of battery 120 is connected to a body earth of vehicle 10.

Battery 120 is provided with a voltage sensor 125. Voltage sensor 125 detects an output voltage VB of battery 120 and outputs a detection value to ECU 300.

A voltage of battery 120 is supplied to ECU 300 and such auxiliary machinery as an inverter of an air-conditioning apparatus through a DC/DC converter 127.

Relay RY1 has one end connected to a positive electrode of battery 120 and the other end connected to one end of solenoid 230 within starter 200. Relay RY1 is controlled by a control signal SE1 from ECU 300 so as to switch between supply and cut-off of a supply voltage from battery 120 to solenoid 230.

Relay RY2 has one end connected to the positive electrode of battery 120 and the other end connected to motor 220 within starter 200. Relay RY2 is controlled by a control signal SE2 from ECU 300 so as to switch between supply and cut-off of a supply voltage from battery 120 to motor 220. In addition, a voltage sensor 130 is provided in a power line connecting relay RY2 and motor 220 to each other. Voltage sensor 130 detects a motor voltage VM and outputs a detection value to ECU 300.

As described above, supply of a supply voltage to motor 220 and solenoid 230 within starter 200 can independently be controlled by relays RY1, RY2.

Output member 250 is coupled to a rotation shaft of a rotor (not shown) within the motor, for example, by a straight spline or the like. In addition, pinion gear 260 is provided on an end portion of output member 250 opposite to motor 220. As relay RY2 is closed, the supply voltage is supplied from battery 120 so as to rotate motor 220. Then, output member 250 transmits the rotational operation of the rotor to pinion gear 260, to thereby rotate pinion gear 260.

As described above, solenoid 230 has one end connected to relay RY1 and the other end connected to the body earth. As relay RY1 is closed and solenoid 230 is excited, solenoid 230 attracts plunger 210 in a direction of an arrow. Namely, plunger 210 and solenoid 230 constitute an actuator 232.

Plunger 210 is coupled to output member 250 with coupling portion 240 being interposed. As solenoid 230 is excited, plunger 210 is attracted in the direction of the arrow. Thus, coupling portion 240 of which fulcrum 245 is fixed moves output member 250 from a stand-by position shown in FIG. 1 in a direction reverse to a direction of operation of plunger 210, that is, a direction in which pinion gear 260 moves away from a main body of motor 220. In addition, biasing force reverse to the arrow in FIG. 1 is applied to plunger 210 by a not-shown spring mechanism, and when solenoid 230 is no longer excited, it returns to the stand-by position.

As output member 250 thus operates in an axial direction as a result of excitation of solenoid 230, pinion gear 260 is engaged with ring gear 110 provided around an outer circumference of a flywheel or a drive plate attached to crankshaft 111 of engine 100. Then, as pinion gear 260 performs a rotational operation while pinion gear 260 and ring gear 110 are engaged with each other, engine 100 is cranked and started.

Thus, in the present embodiment, actuator 232 for moving pinion gear 260 so as to be engaged with ring gear 110 provided around the outer circumference of the flywheel or the drive plate of engine 100 and motor 220 for rotating pinion gear 260 are individually controlled.

Though not shown in FIG. 1, a one-way clutch may be provided between output member 250 and a rotor shaft of motor 220 such that the rotor of motor 220 does not rotate due to the rotational operation of ring gear 110.

In addition, actuator 232 in FIG. 1 is not limited to the mechanism as above so long as it is a mechanism capable of transmitting rotation of pinion gear 260 to ring gear 110 and switching between a state that pinion gear 260 and ring gear 110 are engaged with each other and a state that they are not engaged with each other. For example, such a mechanism that pinion gear 260 and ring gear 110 are engaged with each other as a result of movement of the shaft of output member 250 in a radial direction of pinion gear 260 is also applicable.

ECU 300 includes a CPU (Central Processing Unit), a storage device, and an input/output buffer, none of which is shown, and receives input from each sensor or provides output of a control command to each piece of equipment. It is noted that control of these components is not limited to processing by software, and a part thereof may also be constructed by dedicated hardware (electronic circuitry) and processed.

ECU 300 receives a signal ACC indicating an amount of operation of an accelerator pedal 140 from a sensor (not shown) provided on accelerator pedal 140. ECU 300 receives a signal BRK indicating an amount of operation of a brake pedal 150 from a sensor (not shown) provided on brake pedal 150. In addition, ECU 300 receives a start operation signal IG-ON issued in response to a driver's ignition operation or the like. Based on such information, ECU 300 generates a signal requesting start of engine 100 and a signal requesting stop thereof and outputs control signal SE1, SE2 in accordance therewith, so as to control an operation of starter 200.

For example, when such a stop condition that a vehicle stops, brake pedal 150 is operated by a driver, and stop of engine 100 is not restricted (is permitted) is satisfied, a stop request signal is generated and ECU 300 causes engine 100 to stop. Namely, when a stop condition is satisfied, fuel injection and combustion in engine 100 is stopped.

Thereafter, when such a start condition that an amount of operation of brake pedal 150 by the driver has attained to zero is satisfied, a start request signal is generated and ECU 300 drives motor 220 and cranks engine 100. Alternatively, engine 100 may be cranked when accelerator pedal 140, a shift lever for selecting a shift range or a gear, or a switch for selecting a vehicle running mode (such as a power mode or an eco mode) is operated.

When a condition for starting engine 100 is satisfied, ECU 300 controls actuator 232 and motor 220 in any one mode of a first mode in which actuator 232 and motor 220 are controlled such that pinion gear 260 starts to rotate after pinion gear 260 moved toward ring gear 110 and a second mode in which actuator 232 and motor 220 are controlled such that pinion gear 260 moves toward ring gear 110 after pinion gear 260 started to rotate.

As will be described later, when engine rotation speed Ne is equal to or lower than a predetermined first reference value $\alpha 1$, ECU 300 controls actuator 232 and motor 220 in the first mode. When engine rotation speed Ne is higher than first reference value $\alpha 1$, ECU 300 controls actuator 232 and motor 220 in the second mode.

Figure 2:
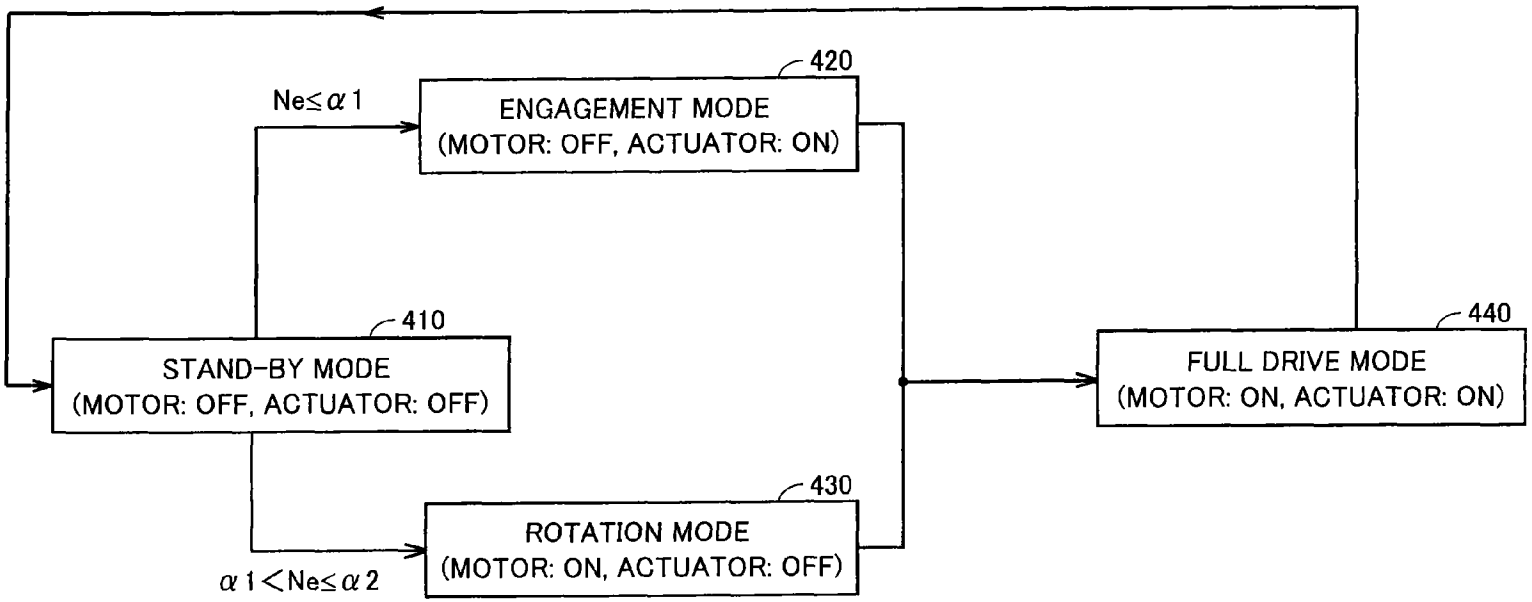
FIG. 2 is a diagram for illustrating transition of an operation mode of a starter.

FIG. 2 is a diagram for illustrating transition of an operation mode of starter 200 in the present embodiment. The operation mode of starter 200 in the present embodiment includes a stand-by mode 410, an engagement mode 420, a rotation mode 430, and a full drive mode 440.

The first mode described previously is a mode in which transition to full drive mode 440 is made via engagement mode 420. The second mode is a mode in which transition to full drive mode 440 is made via rotation mode 430.

Stand-by mode 410 represents such a state that neither of actuator 232 and motor 220 in starter 200 is driven, that is, a state that an engine start request to starter 200 is not output. Stand-by mode 410 corresponds to the initial state of starter 200, and it is selected when drive of starter 200 is not necessary, for example, before an operation to start engine 100, after completion of start of engine 100, failure in starting engine 100, and the like.

Full drive mode 440 represents such a state that both of actuator 232 and motor 220 in starter 200 are driven. In this full drive mode 440, motor 220 rotates pinion gear 260 while pinion gear 260 and ring gear 110 are engaged with each other. Thus, engine 100 is actually cranked and the operation for start is started.

As described above, starter 200 in the present embodiment can independently drive each of actuator 232 and motor 220. Therefore, in a process of transition from stand-by mode 410 to full drive mode 440, there are a case where actuator 232 is driven prior to drive of motor 220 (that is, corresponding to engagement mode 420) and a case where motor 220 is driven prior to drive of actuator 232 (that is, corresponding to rotation mode 430).

Selection between these engagement mode 420 and rotation mode 430 is basically made based on rotation speed Ne of engine 100 when re-start of engine 100 is requested.

Engagement mode 420 refers to a state where only actuator 232 is driven and motor 220 is not driven. This mode is selected when pinion gear 260 and ring gear 110 can be engaged with each other even while pinion gear 260 remains stopped. Specifically, while engine 100 remains stopped or while rotation speed Ne of engine 100 is sufficiently low (Ne≤first reference value $\alpha 1$), this engagement mode 420 is selected.

Meanwhile, rotation mode 430 refers to a state where only motor 220 is driven and actuator 232 is not driven. This mode is selected, for example, when a request for re-start of engine 100 is output immediately after stop of engine 100 is requested and when rotation speed Ne of engine 100 is relatively high ($\alpha 1$<Ne≤a second reference value $\alpha 2$).

Thus, when rotation speed Ne of engine 100 is high, difference in speed between pinion gear 260 and ring gear 110 is great while pinion gear 260 remains stopped, and engagement between pinion gear 260 and ring gear 110 may become difficult. Therefore, in rotation mode 430, only motor 220 is driven prior to drive of actuator 232, so that a rotation speed of ring gear 110 and a rotation speed of pinion gear 260 are in synchronization with each other. Then, in response to difference between the rotation speed of ring gear 110 and the rotation speed of pinion gear 260 being sufficiently small, actuator 232 is driven and ring gear 110 and pinion gear 260 are engaged with each other. Then, the operation mode makes transition from rotation mode 430 to full drive mode 440.

In the case of full drive mode 440, the operation mode returns from full drive mode 440 to stand-by mode 410 in response to completion of start of engine 100 and start of a self-sustained operation of engine 100.

Thus, when a signal requesting start of engine 100 is output, that is, when it is determined that engine 100 is to be started, actuator 232 and motor 220 are controlled in any one mode of the first mode in which transition to full drive mode 440 is made via engagement mode 420 and the second mode in which transition to full drive mode 440 is made via rotation mode 430.

Figure 3:
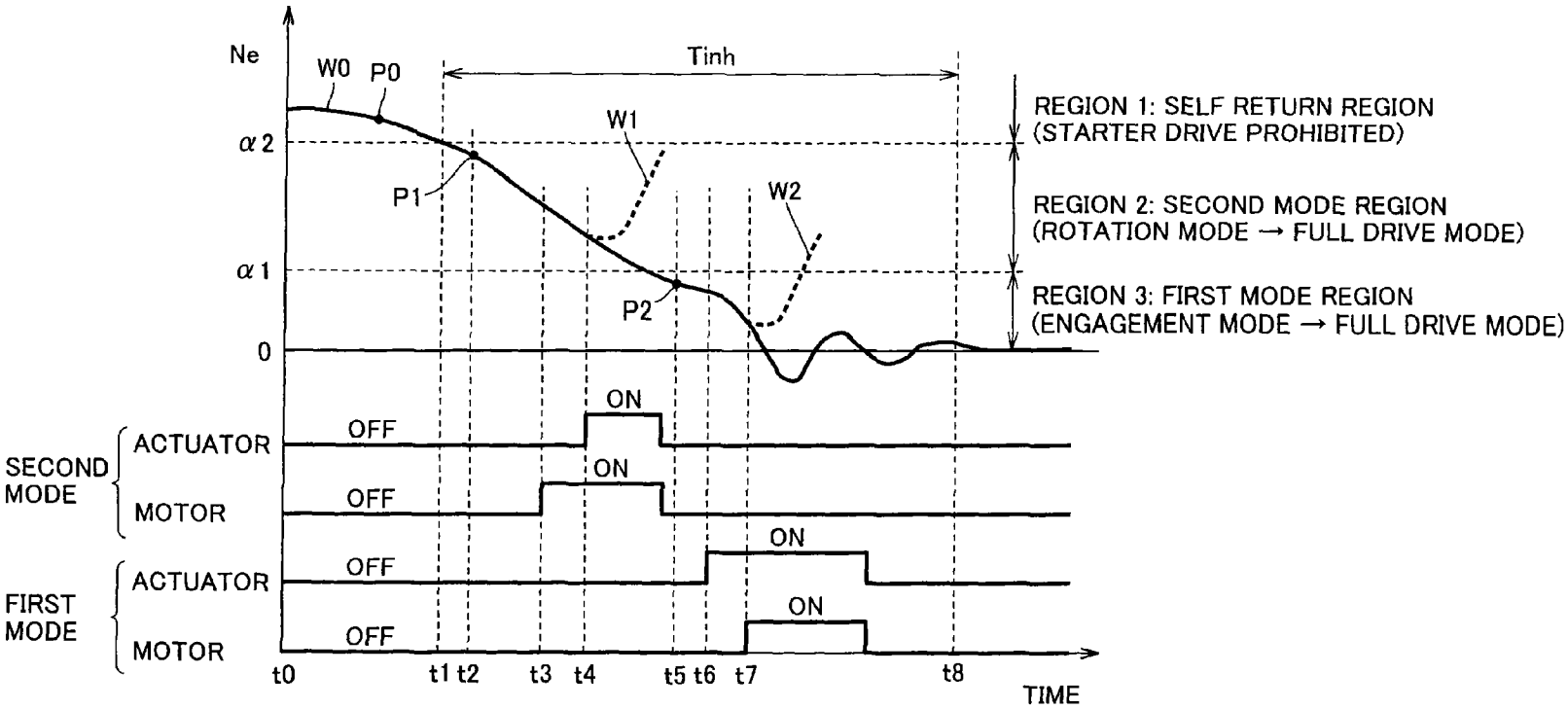
FIG. 3 is a diagram for illustrating a drive mode in an engine start operation.

FIG. 3 is a diagram for illustrating two drive modes (the first mode, the second mode) in an engine start operation in the present embodiment.

In FIG. 3, the abscissa indicates time and the ordinate indicates rotation speed Ne of engine 100 and a state of drive of actuator 232 and motor 220 in the first mode and the second mode.

A case where, at a time t0, for example, such a stop condition that the vehicle stops and the driver operates brake pedal 150 is satisfied and consequently a request to stop engine 100 is generated and engine 100 is stopped (fuel injection and ignition are stopped) is considered. Here, unless engine 100 is re-started, rotation speed Ne of engine 100 gradually lowers as shown with a solid curve WO and finally rotation of engine 100 stops.

Then, a case where, for example, such a start condition that an amount of the driver's operation of brake pedal 150 attains to zero while rotation speed Ne of engine 100 is lowering is satisfied and thus a request to re-start engine 100 is generated is considered. Here, categorization into three regions based on rotation speed Ne of engine 100 is made.

A first region (region 1) refers to a case where rotation speed Ne of engine 100 is higher than second reference value α2, and for example, such a state that the start condition is satisfied and a request for re-start is generated at a point PO in FIG. 3.

This region 1 is a region where engine 100 can be started by a fuel injection and ignition operation without using starter 200 because rotation speed Ne of engine 100 is sufficiently high. Namely, region 1 is a region where engine 100 can return by itself. Therefore, in region 1, drive of starter 200 is restricted, or more specifically, prohibited. It is noted that second reference value α2 described above may be restricted depending on a maximum rotation speed of motor 220.

A second region (region 2) refers to a case where rotation speed Ne of engine 100 is located between first reference value α1 and second reference value α2, and such a state that the start condition is satisfied and a request for re-start is generated at a point P1 in FIG. 3.

This region 2 is a region where rotation speed Ne of engine 100 is relatively high, although engine 100 cannot return by itself. In this region, the rotation mode is selected as described with reference to FIG. 2.

When a request to re-start engine 100 is generated at a time t2, initially, motor 220 is driven after lapse of a prescribed time period. Thus, pinion gear 260 starts to rotate. Here, a rotation speed of pinion gear 260, that is, a rotation speed of motor 220, is estimated based on a time period of conduction or the like. Relation between a rotation speed of motor 220 and a time period of conduction is specified in advance by a developer based on results in experiments, simulation, and the like.

Then, at a time t4 when it is estimated that the rotation speed of ring gear 110 is in synchronization with the rotation speed of pinion gear 260, actuator 232 is driven. Then, when ring gear 110 and pinion gear 260 are engaged with each other, engine 100 is cranked and rotation speed Ne of engine 100 increases as shown with a dashed curve W1. Thereafter, when engine 100 resumes the self-sustained operation, drive of actuator 232 and motor 220 is stopped.

A third region (region 3) refers to a case where rotation speed Ne of engine 100 is lower than first reference value α1, and for example, such a state that the start condition is satisfied and a request for re-start is generated at a point P2 in FIG. 3.

This region 3 is a region where rotation speed Ne of engine 100 is low and pinion gear 260 and ring gear 110 can be engaged with each other without synchronizing pinion gear 260. In this region, the engagement mode is selected as described with reference to FIG. 2.

When a request to re-start engine 100 is generated at a time t5, initially, actuator 232 is driven after lapse of a prescribed time period. Thus, pinion gear 260 is pushed toward ring gear 110. Motor 220 is thereafter driven (at a time t7 in FIG. 3). Thus, engine 100 is cranked and rotation speed Ne of engine 100 increases as shown with a dashed curve W2. Thereafter, when engine 100 resumes the self-sustained operation, drive of actuator 232 and motor 220 is stopped.

By thus controlling re-start of engine 100 by using starter 200 in which actuator 232 and motor 220 can independently be driven, engine 100 can be re-started in a shorter period of time than in a case of a conventional starter where an operation to re-start engine 100 was prohibited during a period (Tinh) from a rotation speed at which return of engine 100 by itself was impossible (a time t1 in FIG. 3) to stop of engine 100 (a time t8 in FIG. 3). Thus, the driver's uncomfortable feeling due to delayed re-start of the engine can be lessened.

As described above, by carrying out the rotation mode in a region where rotation speed Ne of engine 100 is intermediate between first reference value α1 and second reference value α2, ring gear 110 and pinion gear 260 are brought in synchronization with each other. In the case where a rotation speed of engine 100 cannot be specified, for example, due to a communication error, failure of rotation speed sensor 115, or the like, however, synchronization between ring gear 110 and pinion gear 260 is restricted. Namely, accuracy in synchronization between ring gear 110 and pinion gear 260 may become poor, synchronization may be difficult, or synchronization may be impossible.

In addition, similarly, in the case where a rotation speed of pinion gear 260, that is, a rotation speed of motor 220, cannot accurately be estimated due to a communication error, failure of various sensors, or the like, synchronization between ring gear 110 and pinion gear 260 is restricted. Moreover, in the case where relation between a rotation speed of motor 220 and a time period of conduction changes due to change in voltage characteristics of battery 120 or output characteristics of motor 220, control of synchronization between ring gear 110 and pinion gear 260 may become poor. Therefore, synchronization between ring gear 110 and pinion gear 260 is restricted.

In the present embodiment, the rotation mode is restricted in the case where synchronization between ring gear 110 and pinion gear 260 is restricted. More specifically, the rotation mode is prohibited. When synchronization between ring gear 110 and pinion gear 260 is restricted and consequently the rotation mode is restricted, as shown with a solid line in FIG. 4, a rate of lowering in engine rotation speed Ne is made greater than a rate of lowering in engine rotation speed Ne during normal operation shown with a dashed line. For example, a phase of an intake valve is advanced to a phase of a most advanced angle by VVT mechanism 102, in order to increase pumping loss. Alternatively, a rate of lowering in engine rotation speed Ne may be increased by increasing load imposed by auxiliary machinery.

In particular in the case where a rotation speed of engine 100 cannot be specified, in addition to or instead of increase in rate of lowering in engine rotation speed Ne, when a time elapsed since a condition for stopping engine 100 was satisfied or a time elapsed since stop of fuel injection and ignition exceeds a prescribed time period Δt, the engagement mode is selected.

Figure 4:
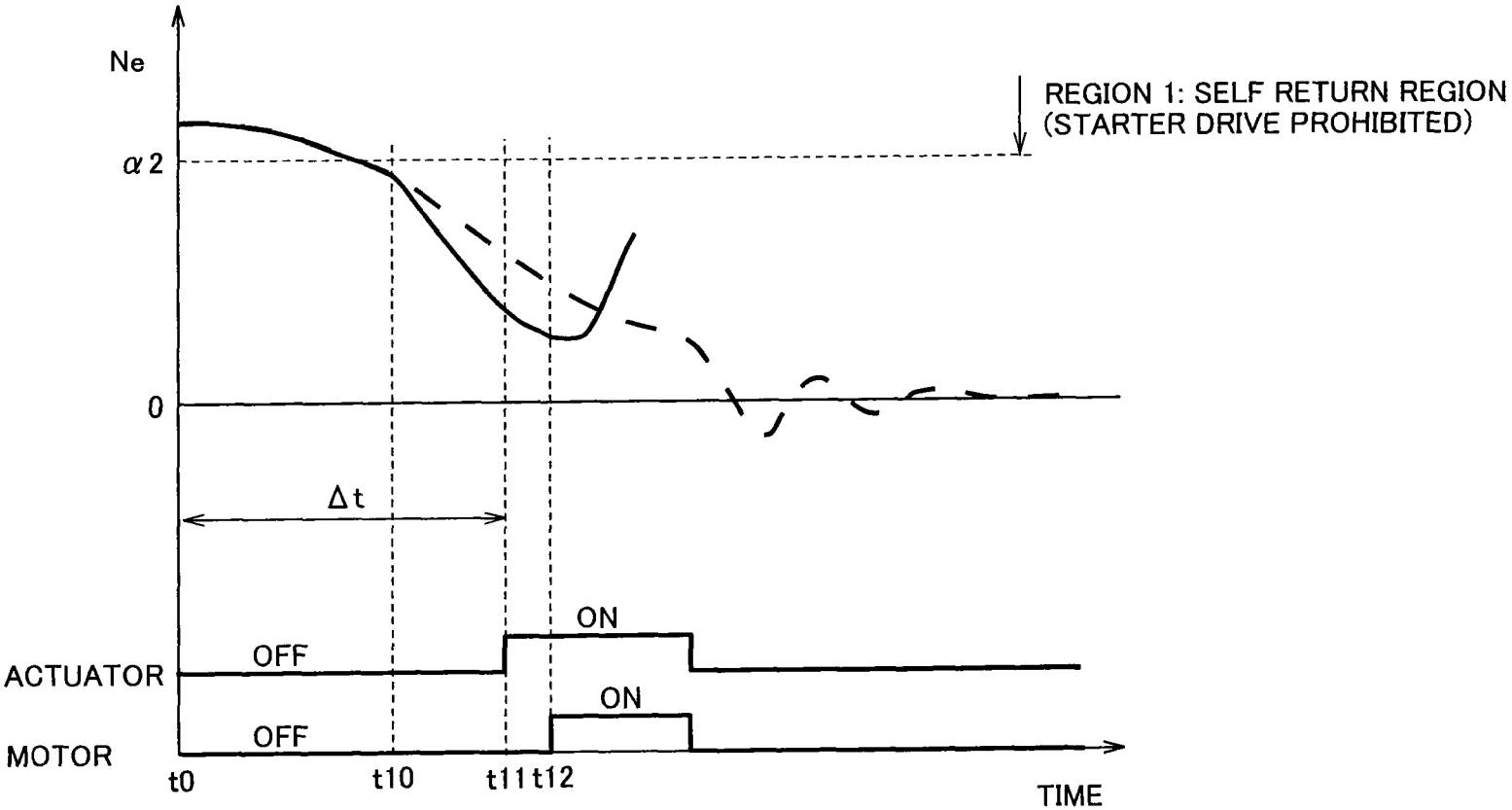
FIG. 4 is a diagram for illustrating a drive mode at the time when it is impossible to specify a rotation speed of an engine.

Therefore, as shown in FIG. 4, when a request for re-starting engine 100 is generated at a time t10 and when a time elapsed since a condition for stopping engine 100 was satisfied or a time elapsed since stop of fuel injection and ignition exceeds prescribed time period Δt at a time t11, actuator 232 is driven. Thereafter, motor 220 is driven (a time t12 in FIG. 4). Engine 100 is thus cranked and rotation speed Ne of engine 100 increases. Thereafter, when engine 100 resumes the self-sustained operation, drive of actuator 232 and motor 220 is stopped. Prescribed time period Δt is predetermined by a developer based on experiments and simulation, as a time period required for engine rotation speed Ne to sufficiently become low. For example, prescribed time period Δt is determined as a time period required for engine rotation speed Ne to lower to first reference value α1 or lower.

Figure 5:
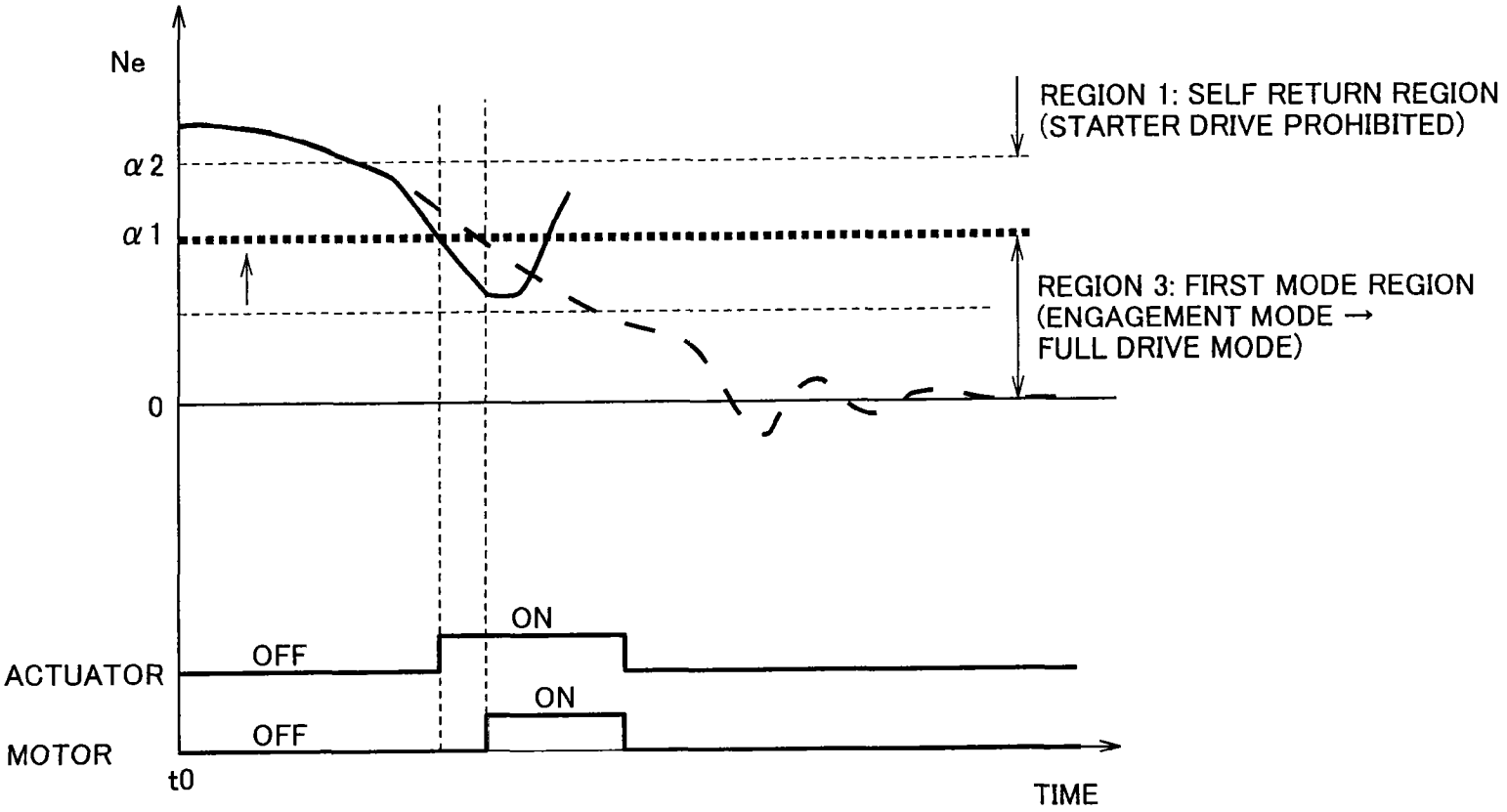
FIG. 5 is a diagram for illustrating a drive mode at the time when it is impossible to estimate a rotation speed of a motor.

On the other hand, in particular in a case where a rotation speed of motor 220 cannot be estimated although a rotation speed of engine 100 can be specified, in addition to or instead of increase in rate of lowering in engine rotation speed Ne, first reference value α1 is increased as shown in FIG. 5.

Figure 6:
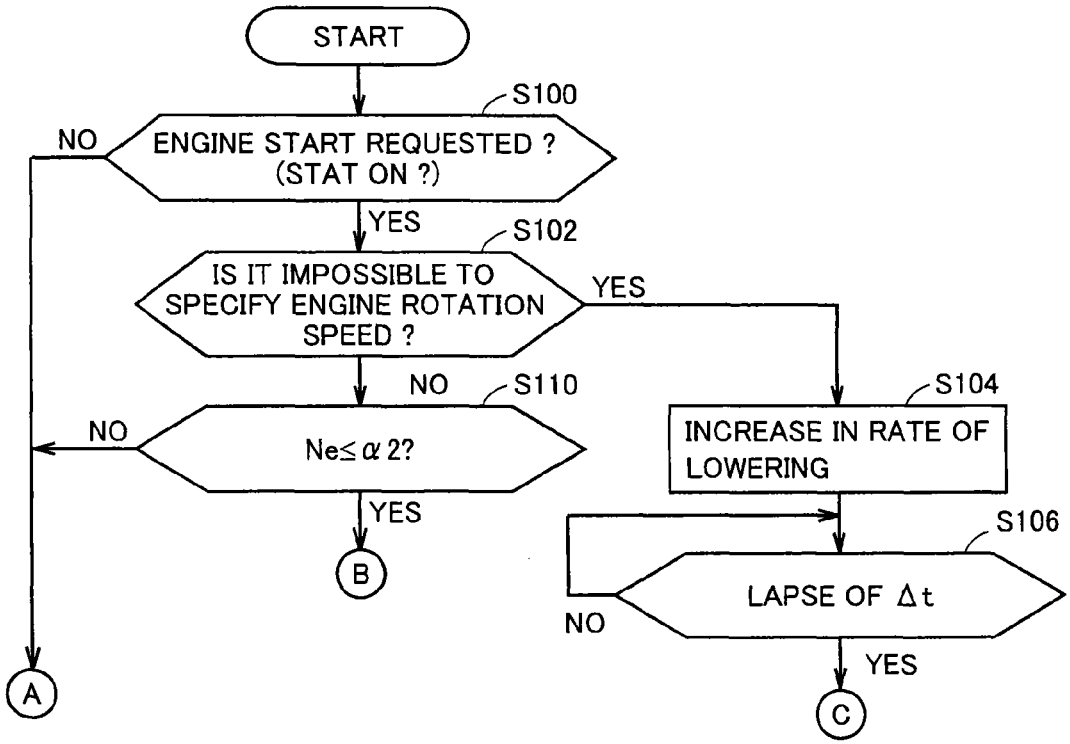
FIG. 6 is a flowchart (No. 1) showing processing performed by an ECU.
Figure 7:
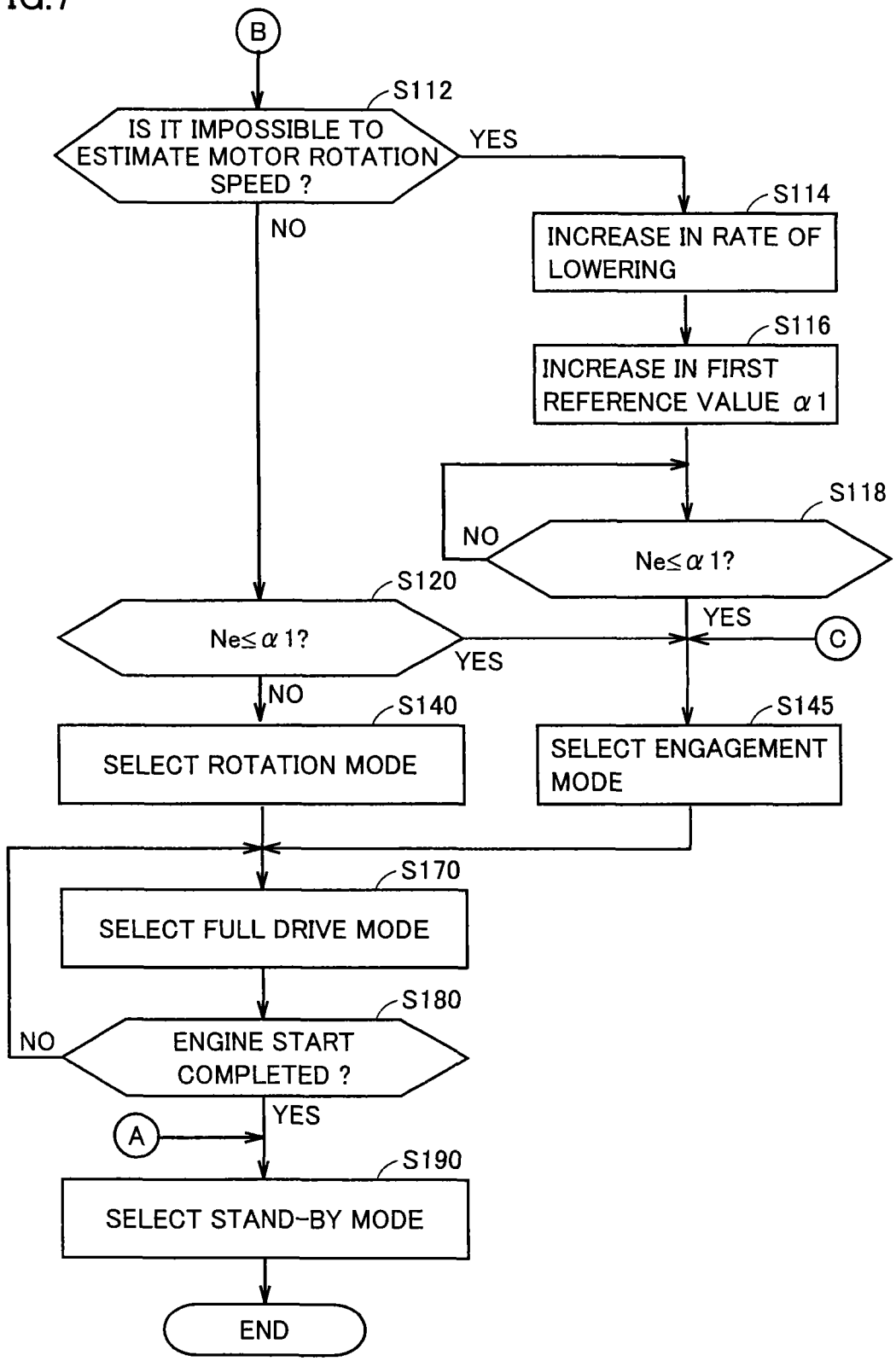
FIG. 7 is a flowchart (No. 2) showing processing performed by the ECU.

Processing performed by ECU 300 for starting engine 100 after a condition for stopping engine 100 is satisfied will be described below with reference to FIGS. 6 and 7. The flowcharts shown in FIGS. 6 and 7 are realized by executing a program stored in advance in ECU 300 in a prescribed cycle. Alternatively, regarding some steps, processing can also be performed by constructing dedicated hardware (electronic circuitry).

In step (hereinafter the step being abbreviated as S) 100, ECU 300 determines whether or not a condition for starting engine 100 has been satisfied or not. Namely, whether or not to start engine 100 is determined. When a condition for starting engine 100 is not satisfied (NO in S100), the process proceeds to S190 and ECU 300 selects the stand-by mode as the operation mode for starter 200 because an operation to start engine 100 is not necessary.

When a condition for starting engine 100 is satisfied (YES in S100), the process proceeds to S102. In S102, ECU 300 determines whether or not it is impossible to specify rotation speed Ne of engine 100. When a communication error, failure of rotation speed sensor 115, or the like is detected, it is determined that it is impossible to specify a rotation speed of engine 100. It is noted that, since whether or not it is impossible to specify rotation speed Ne of engine 100 should only be determined by making use of a well-known, general technique, detailed description thereof will not be repeated here.

When it is impossible to specify rotation speed Ne of engine 100 (YES in S102), in S104, ECU 300 increases a rate of lowering in rotation speed Ne of engine 100. Thereafter, when a time elapsed since a stop condition was satisfied or a time elapsed since stop of fuel injection and ignition exceeds prescribed time period Δt (YES in S104), the process proceeds to S145.

In S145, ECU 300 selects the engagement mode as the operation mode for starter 200. Then, ECU 300 outputs control signal SE1 so as to close relay RY1, and thus actuator 232 is driven. Here, motor 220 is not driven.

Thereafter, the process proceeds to S170 and ECU 300 selects the full drive mode as the operation mode for starter 200. Then, starter 200 starts cranking of engine 100.

Then, in S180, ECU 300 determines whether or not start of engine 100 has been completed. Determination of completion of start of engine 100 may be made, for example, based on whether or not the engine rotation speed is higher than a threshold value γ indicating the self-sustained operation after lapse of a prescribed period of time since start of drive of motor 220.

When start of engine 100 has not been completed (NO in S180), the process returns to S170 and cranking of engine 100 is continued. When start of engine 100 has been completed (YES in S180), the process proceeds to S190 and ECU 300 selects the stand-by mode as the operation mode for starter 200.

When it is possible to specify rotation speed Ne of engine 100 (NO in S 102), the process proceeds to S110 and ECU 300 then determines whether or not rotation speed Ne of engine 100 is equal to or lower than second reference value α2.

When rotation speed Ne of engine 100 is higher than second reference value α2 (NO in S110), engine rotation speed Ne corresponds to region 1 in FIG. 3 where engine 100 can return by itself. Therefore, ECU 300 causes the process to proceed to S190 and selects the stand-by mode. Thereafter, ECU 300 resumes fuel injection and combustion in order to re-start engine 100.

When rotation speed Ne of engine 100 is equal to or lower than second reference value α2 (YES in S110), the process proceeds to S112. In S112, ECU 300 determines whether or not it is impossible to estimate a rotation speed of motor 220. When a communication error, failure of various sensors (such as a current sensor of battery 120), or the like is detected, it is determined that it is impossible to estimate a rotation speed of motor 220. It is noted that a method for determining whether or not it is impossible to estimate a rotation speed of motor 220 is not limited as such.

When it is possible to estimate a rotation speed of motor 220 (NO in S112), in S120, ECU 300 determines whether or not rotation speed Ne of engine 100 is equal to or lower than first reference value α1.

A case where rotation speed Ne of engine 100 is equal to or lower than first reference value α1 (YES in S120) corresponds to region 1 in FIG. 4, and therefore the process proceeds to S145 and ECU 300 selects the engagement mode. Then, ECU 300 outputs control signal SE1 so as to close relay RY1, and thus actuator 232 is driven. Here, motor 220 is not driven.

Thereafter, the process proceeds to S170 and ECU 300 selects the full drive mode. Then, starter 200 starts cranking of engine 100. When start of engine 100 has not been completed (NO in S180), the process returns to S170 and cranking of engine 100 is continued. When start of engine 100 has been completed (YES in S180), the process proceeds to S190 and ECU 300 selects the stand-by mode.

On the other hand, when rotation speed Ne of engine 100 is higher than first reference value α1 (NO in S120), the process proceeds to S140 and ECU 300 selects the rotation mode. Then, ECU 300 outputs control signal SE2 so as to close relay RY2, and thus motor 220 is driven. Here, actuator 232 is not driven.

Then, ECU 300 selects in S170 the full drive mode. Thus, actuator 232 is driven, pinion gear 260 and ring gear 110 are engaged with each other, and engine 100 is cranked. When start of engine 100 has not been completed (NO in S180), the process returns to S170 and cranking of engine 100 is continued. When start of engine 100 has been completed (YES in S180), the process proceeds to S190 and ECU 300 selects the stand-by mode.

When it is impossible to estimate a rotation speed of motor 220 (YES in S 112), in S114, ECU 300 increases a rate of lowering in rotation speed Ne of engine 100. In addition, in S116, ECU 300 increases first reference value Δ1. Thereafter, when rotation speed Ne of engine 100 lowers to first reference value Δ1 or lower (YES in S118), the engagement mode is selected in S145. Thereafter, the process proceeds to S170 and ECU 300 selects the full drive mode. Then, starter 200 starts cranking of engine 100. When start of engine 100 has been completed (YES in S180), the process proceeds to S190 and ECU 300 selects the stand-by mode.

It is noted that, when it is impossible to estimate a rotation speed of motor 220, only first reference value Δ1 may be changed, for example, increased, without changing a rate of lowering in rotation speed Ne of engine 100.

As described above, in the present embodiment, in the case where synchronization between ring gear 110 and pinion gear 260 is restricted, the rotation mode in which pinion gear 260 is rotated before drive of actuator 232 for moving pinion gear 260 to the position where pinion gear 260 is engaged with ring gear 110 is restricted. Therefore, unintended increase in difference between the rotation speed of ring gear 110 and the rotation speed of pinion gear 260 can be avoided.

It should be understood that the embodiments disclosed herein are illustrative and non-restrictive in every respect. The scope of the present invention is defined by the terms of the claims, rather than the description above, and is intended to include any modifications within the scope and meaning equivalent to the terms of the claims.

Reference Signs List

10 vehicle; 100 engine; 102 VVT mechanism; 110 ring gear; 111 crankshaft; 115 rotation speed sensor; 120 battery; 125, 130 voltage sensor; 140 accelerator pedal; 150 brake pedal; 160 powertrain; 170 drive wheel; 200, 202 starter; 210 plunger; 220 motor; 230 solenoid; 232 actuator; 240 coupling portion; 245 fulcrum; 250 output member; 260 pinion gear; 270 one-way clutch; 300 ECU; 410 stand-by mode; 420 engagement mode; 430 rotation mode; 440 full drive mode; and RY1, RY2 relay.

The invention claimed is:

1. A control device for a starter, said starter including a second gear that can be engaged with a first gear coupled to a crankshaft of an engine, an actuator that moves, in a driven state, said second gear to a position where said second gear is engaged with said first gear, and a motor that rotates said second gear, comprising:

a control unit that drives said actuator and said motor in a rotation mode in which said motor is driven before said actuator is driven, wherein said rotation mode is restricted when a rotation speed of said engine cannot be determined, a phase of an intake valve of said engine is advanced when a rotation speed of said engine cannot be determined, and said actuator and said motor are driven in an engagement mode in which said second gear is engaged with said first gear when a rotation speed of said engine is equal to or lower than an upper limit value.

2. The control device for a starter according to claim 1, wherein when a rotation speed of said engine cannot be determined, said upper limit value is increased.

3. A method of controlling a starter, said starter including a second gear that can be engaged with a first gear coupled to a crankshaft of an engine, an actuator that moves, in a driven state, said second gear to a position where said second gear is engaged with said first gear, and a motor that rotates said second gear, comprising the steps of:

driving said actuator and said motor in a rotation mode in which said motor is driven prior to drive of said actuator;

restricting said rotation mode when a rotation speed of said engine cannot be determined;

advancing a phase of an intake valve of said engine when a rotation speed of said engine cannot be determined; and driving said actuator and said motor in an engagement mode in which said second gear is engaged with said first gear when a rotation speed of said engine is equal to or lower than an upper limit value.

4. A vehicle, comprising:

an engine;

a starter including a second gear that can be engaged with a first gear coupled to a crankshaft of said engine, an actuator that moves, in a driven state, said second gear to a position where said second gear is engaged with said first gear, and a motor that rotates said second gear; and a control unit that drives said actuator and said motor in a rotation mode in which said motor is driven before said actuator is driven, wherein said rotation mode is restricted when a rotation speed of said engine cannot be determined, a phase of an intake valve of said engine is advanced when a rotation speed of said engine cannot be determined, and said actuator and said motor are driven in an engagement mode in which said second gear is engaged with said first gear when a rotation speed of said engine is equal to or lower than an upper limit value.

5. A control device for a starter, said starter including a second gear that can be engaged with a first gear coupled to a crankshaft of an engine, an actuator that moves, in a driven state, said second gear to a position where said second gear is engaged with said first gear, and a motor that rotates said second gear, comprising:

a control unit that executes a rotation mode in which said motor is driven before said actuator is driven, wherein when a rotation speed of said engine cannot be determined, a rate of lowering in engine rotation speed is increased to be greater than a rate of lowering in engine rotation speed when a rotation speed of said engine can be determined and said control unit executes an engagement mode in which said actuator is driven before said motor is driven.

6. The control device for a starter according to claim 5, wherein when a rotation speed of said engine cannot be determined, said engagement mode is executed after a prescribed time period elapses.

* * * * *